US006475041B1

(12) United States Patent
Lappöhn et al.

(10) Patent No.: US 6,475,041 B1
(45) Date of Patent: Nov. 5, 2002

(54) ONE-PIECE TWO-LEG CONTACT SPRING

(75) Inventors: Jürgen Lappöhn, Heiningen (DE); Franz Czeschka, Rechberghausen (DE)

(73) Assignee: Erni Elektroapparate GmbH, Adelberg (DE)

( * ) Notice: Subject to any disclaimer, the term of this patent is extended or adjusted under 35 U.S.C. 154(b) by 0 days.

(21) Appl. No.: 09/373,526

(22) Filed: Aug. 12, 1999

Related U.S. Application Data

(63) Continuation of application No. 08/281,053, filed on Jul. 27, 1994, now abandoned.

(30) Foreign Application Priority Data

Sep. 8, 1993 (DE) ..... 43 30 590

(51) Int. Cl.[7] ..... H01R 13/11; H01R 11/22
(52) U.S. Cl. ..... 439/856; 439/842; 439/857
(58) Field of Search ..... 439/842, 856, 439/857

(56) References Cited

U.S. PATENT DOCUMENTS

| | | | | |
|---|---|---|---|---|
| 2,779,011 A | | 1/1957 | Deakin | |
| 4,175,821 A | * | 11/1979 | Hunter | 439/856 OR |
| 4,720,276 A | * | 1/1988 | Takahashi | 439/856 X |
| 6,007,389 A | * | 12/1999 | Weber | 439/636 |
| 6,217,395 B1 | * | 4/2001 | Flieger et al. | 439/839 |
| 6,224,432 B1 | * | 5/2001 | Billman | 439/856 |
| 6,254,440 B1 | * | 7/2001 | Ko et al. | 439/857 |
| 6,375,488 B1 | * | 4/2002 | Noro | 439/395 |

FOREIGN PATENT DOCUMENTS

| | | | | |
|---|---|---|---|---|
| CA | 0683981 | * | 4/1964 | 439/842 |
| CA | 683981 | * | 4/1967 | 439/842 |
| DE | 936524 | | 12/1955 | |
| DE | 1847463 | | 8/1958 | |
| DE | 1082645 | | 6/1960 | |
| DE | 2609381 | | 9/1976 | |
| DE | 2555871 | | 6/1977 | |

* cited by examiner

*Primary Examiner*—Tho D. Ta
*Assistant Examiner*—Edwin A. León
(74) *Attorney, Agent, or Firm*—Sidley Austin Brown & Wood, LLP

(57) ABSTRACT

A one-piece contact spring that includes first and second legs and a connection portion connecting the first and second legs, with the first and second legs and the connection portion lying in a common plane, and with the first and second legs having free ends forming an entrance region and defining opposite mirrored contact rounded cups at the entrance region, and each of the free and being bent off by an angle of 90° from the common plane along an elastic line which extends at an acute angle to an axis of symmetry of the contact spring.

3 Claims, 1 Drawing Sheet

ONE-PIECE TWO-LEG CONTACT SPRING

RELATED APPLICATION

This application is a continuation of application Ser. No. 08/281,053, filed Jul. 27, 1994, now abandoned.

BACKGROUND OF THE INVENTION

The invention relates to a one-piece two-leg contact spring having opposite mirrored contact rounded cups manufactured from a metal strip by continuous stamping, with preliminary bending of the entrance region formed by the free ends of the legs.

For manufacturing a two-leg contact spring with a small, e.g., 2.5 mm, width of the slot defined by the two legs, and at a small cost, it is necessary to stamp it out from a continuous metal strip in an appropriate stamp. The ends of the legs of the contact spring produced by this method make it difficult to produce a required bi-lateral contact because, with conventional production methods of forming U-shaped contact body, it cannot be placed any longer into a stamp.

German Patent No. 3,324,737 discloses rather complicated and expensive devices of and methods for shearing, bending and/or bonding to obtain a desired geometry of the finished article.

Accordingly, the object of the invention is a one-piece two-leg contact spring, with opposite mirrored contact rounded cups, which can be simply produced from a flat metal strip by-a simple manufacturing process.

SUMMARY OF THE INVENTION

This, and other objects of the invention which will become apparent hereinafter, are achieved by providing a one-piece two-leg contact spring of the above-discussed type in which the first and second legs and the connection portion lie in a common plane, with the first and second legs having free ends forming an entrance region and defining opposite mirrored contact rounded cups at the entrance region, and with each of the free and being bent off by an angle of 90° from the common plane along an elastic line, which extends at an acute angle to an axis of symmetry of the contact spring.

BRIEF DESCRIPTION OF THE DRAWINGS

The features and objects of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
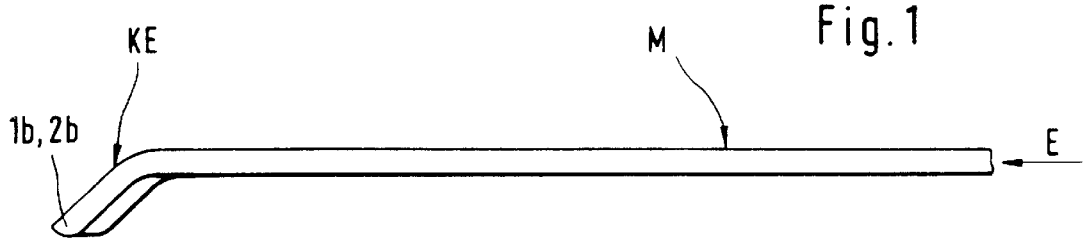
FIG. 1 a side view of a metal strip blank from which a one-piece two-leg contact spring according to the present invention is made.
Figure 2:
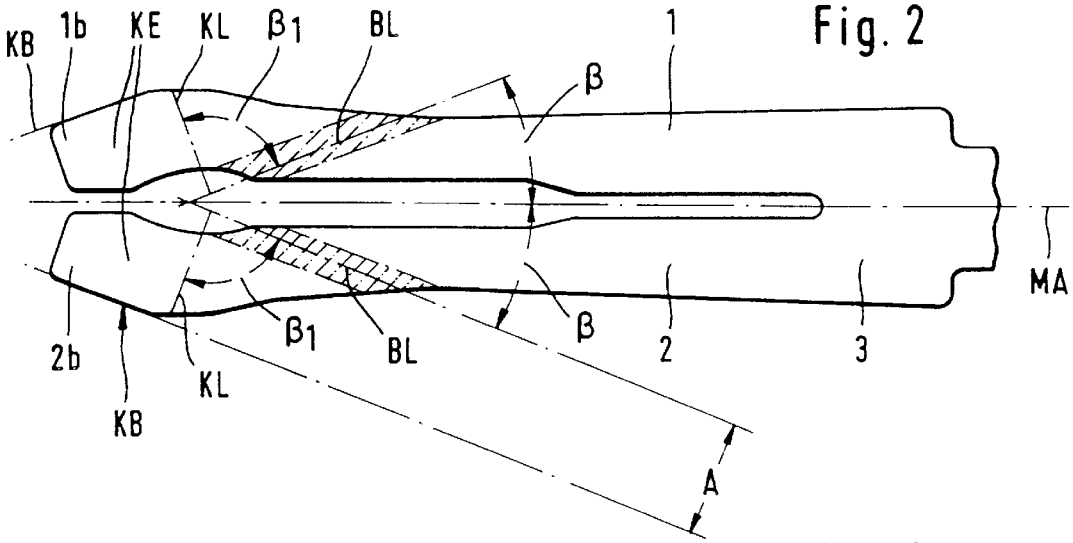
FIG. 2 a top view of the metal strip blank shown in FIG. 1.
Figure 3:
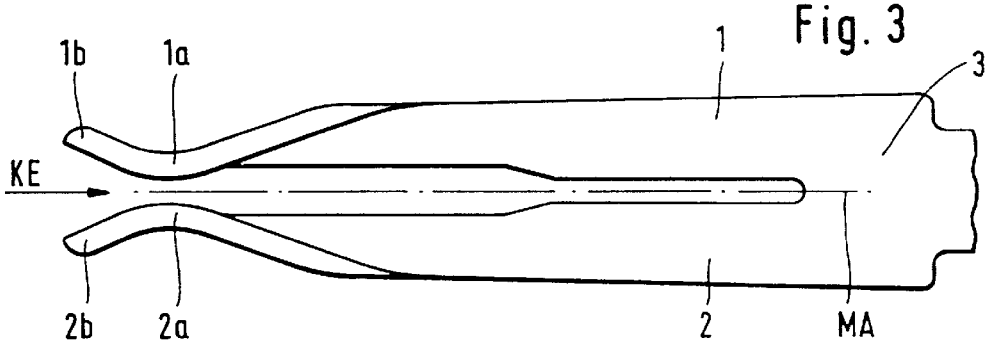
FIG. 3 a top view similar to that of FIG. 2 after the bending step.
Figure 4:
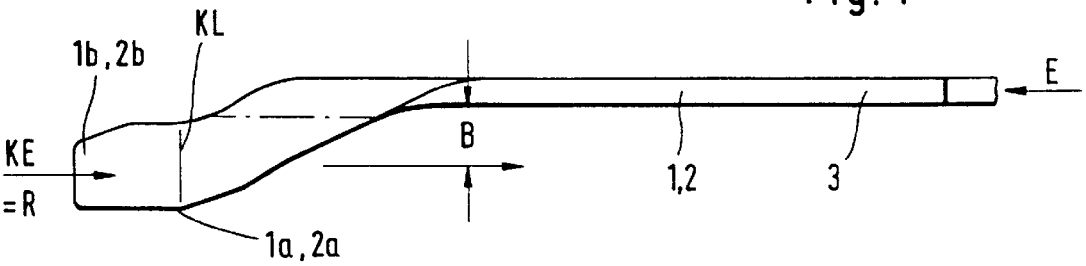
FIG. 4 a side view of a finished contact spring according to the present invention.

The one-piece two-leg contact spring having opposite mirrored contact rounded cups, which is shown in FIGS. 3 and 4, is manufactured from a metal strip blank, as shown in FIGS. 1 and 2, formed by continuous stamping from a metal strip followed by preliminary bending around bending lines which define future contact lines KL cups at the entrance region KE of the contact rounded at the free ends 1*b* and 2*b* of the spring legs 1 and 2.

For achieving the object of the invention, it is necessary that both spring legs 1 and 2 and the leg connection portion 3 be located in the same common plane E, and that free ends 1*b* and 2*b* of the legs 1 and 2, which form the contact region KE, are bent off by an angle of 90° from the common plane E along elastic lines BL, which extend at an angle β to the axis of symmetry MA.

It is important that the lines BL, which extend at an angel β to the axis, and the contact lines KL of the contact rounded cup 1*a* and 2*a* of the spring legs 1 and 2, respectively, form in the common plane E a right angel $\beta_1$, and that both the contact lines KL of the contact rounded cups 1*a* and 1*b* and the elastic lines of the free ends 1*b* and 2*b* are located in plane E to form the contact entrance region KE. In the shown embodiment, the elastic lines extend at an angle of about 20° to the spring axis.

For obtaining an optimal shape of the contact spring according to the invention, it is advantageous when, in the common plane E of the metal strip blank, the outer border lines KB of the entrance region KE extend parallel to at a distance A from respective elastic lines BL, as shown in FIG. 2.

As a result, in the finished contact spring as shown in FIG. 4, the contact entrance region KE is entirely displaced sidewise in direction B and is pivoted by an angle of 90° to the flat spring legs 1 and 2. this permits the use of terminal strips with very long blades.

While the present invention was shown and described with reference to a preferred embodiment, various modifications thereof will be apparent to those skilled in the art and, therefore, it is not intended that the invention be limited to the disclosed embodiment and/or details thereof, and departures can be made therefrom with in the spirit and scope of the appended claims.

What is claimed is:

1. A one-piece contact spring, comprising first and second legs and a connection portion connecting said first and second legs, wherein said first and second legs and said connection portion lie in a common plane, wherein said first and second legs each has a free end, the free ends of the first and second legs forming an entrance region and defining opposite mirrored contact rounded cups at said entrance region, wherein each of said free ends is bent off by an angle of 90° from the common plane along an elastic line which extends at an acute angle to an axis of symmetry of said contact spring, wherein the entire entrance region is displaced sidewise with respect to the common plane of the spring legs and is located entirely on one side of the common plane of the spring legs, and is pivoted by an angle of 90° with respect to the spring legs to provide for an extension through the entrance region of a very long blade, and wherein each elastic line and a respective contact line of a respective rounded cup form together a right angle in the common plane.

2. An contact spring as set forth in claim 1, wherein an outer border line of the entrance region extends parallel to and a predetermined distance from a respective elastic line.

3. A contact spring as set forth in claim 1, wherein contact lines of the rounded cups and the elastic lines, which define bending lines of a metal strip blank provide for formation of the entrance region at the free ends of the spring legs.

* * * * *